United States Patent [19]

Segal

[11] 4,082,333

[45] * Apr. 4, 1978

[54] COMBINATION OF INTERLOCKING SECURITY ON CHAIN DOOR

[76] Inventor: Bernard C. Segal, 150-6 J. Dreiser Loop, Bronx, N.Y. 10475

[ * ] Notice: The portion of the term of this patent subsequent to Jul. 15, 1992, has been disclaimed.

[21] Appl. No.: 680,968

[22] Filed: Apr. 27, 1976

[51] Int. Cl.[2] ..... E05C 19/00

[52] U.S. Cl. ..... 292/264

[58] Field of Search ..... 292/264, 271, 272, 273; 70/93

[56] References Cited

U.S. PATENT DOCUMENTS

| | | | |
|---|---|---|---|
| 878,294 | 2/1908 | Kleidmann | 292/264 |
| 1,987,913 | 1/1935 | Schulz | 292/264 |
| 3,894,762 | 7/1975 | Segal | 292/264 |

FOREIGN PATENT DOCUMENTS

| | | | |
|---|---|---|---|
| 321,918 | 6/1920 | Germany | 292/264 |
| 17,447 of | 1889 | United Kingdom | 292/264 |

*Primary Examiner*—Paul R. Gilliam
*Assistant Examiner*—Kenneth Dorner

[57] ABSTRACT

A chain door guard assembly has a chain fixed at one end with chain heads along its length and a guard plate having a raised main body section and flanges for attaching the guard plate to a door. The main body section of the guard plate contains a long slot and a plurality of entry slots which permit insertion of a plurality of chain heads into the long slot. Two independent entry slots, for accepting a chain head in one instance and a chain-attached slide bolt in the other, are also provided. The resulting chain door guard assembly affords selectively varying degrees of security and convenience, achieved by the insertion of those chain heads into their designated entry slots. This door guard assembly may be used for left or right side door installation.

1 Claim, 10 Drawing Figures

COMBINATION OF INTERLOCKING SECURITY ON CHAIN DOOR

BACKGROUND OF THE INVENTION

This application relates to an improvement on chain door guard disclosed in my U.S. Pat. No. 3,894,762, issued on July 15, 1975, and entitled, COMBINATION OF INTERLOCKING SECURITY ON CHAIN DOOR GUARDS, a continuation in part of U.S. Ser. No. 306,180, filed Dec. 26, 1972.

This invention and its improvement provides the door guard of my hereinbefore mentioned U.S. patent with the feature of reversability so the same door guard may be used with all its advantages on a right or left hand opening door

DESCRIPTION OF THE PREFERRED EMBODIMENTS

Figures 1, 2, 3, 4, 5, 6, 7, 8, 9, 10:
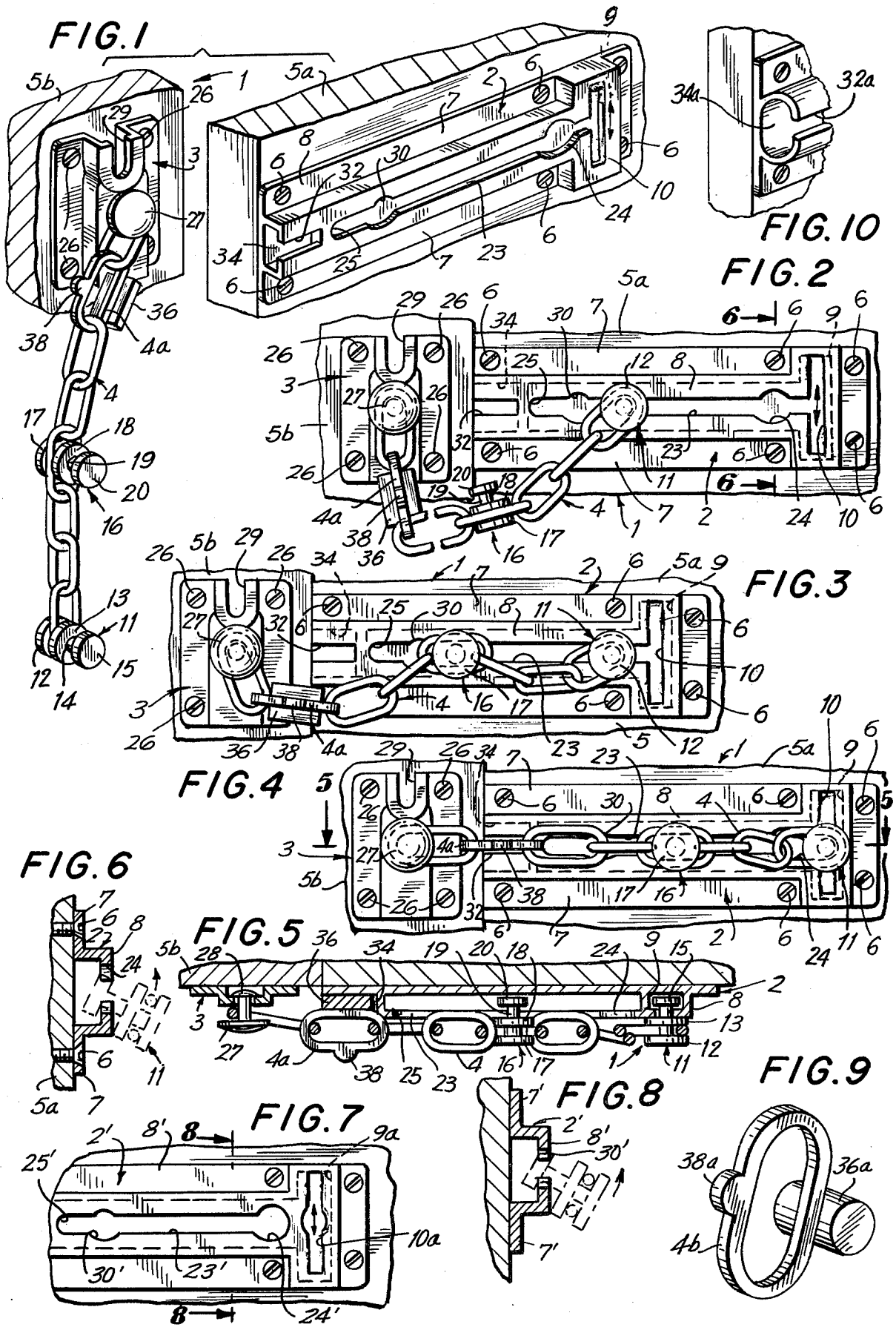
FIG. 1 is a perspective view of a chain door guard assembly according to the present invention, showing the bracket and guard plate thereof and their attachment to a door jamb and door, respectively, with the door open and chain hanging free.
FIG. 2 is a front elevational view of the assembly with the chain in position for restricted door opening to permit maximum inspection capability.
FIG. 3 is a front elevational view of the assembly with the chain in position for allowing a more restricted door opening.
FIG. 4 is a front elevational view of the assembly with the chain in position of maximum security, with any opening of the door precluded.
FIG. 5 is a longitudinal sectional view of the assembly, taken generally along line 5—5 of FIG. 4.
FIG. 6 is a transverse sectional view taken along line 6—6 of FIG. 2 with a chain head shown in phantom lines.
FIG. 7 is a frontal elevational view of a fragment of an alternate embodiment containing a vertically truncated independent slot.
FIG. 8 is a transverse sectional view taken along line 8—8 of FIG. 7 with a chain head shown in phantom lines.
FIG. 9 is a perspective view of a sliding bolt.
FIG. 10 is a perspective view of a fragment of an assembly to accommodate the bolt of FIG. 9.

Referring to the drawings in detail, a chain door guard assembly as shown in FIG. 1, includes a guard plate 2, bracket 3, and chain link 4*a*, Guard plate 2 is fixed by screws 6 or the like to door 5*a*, while bracket 3 is fixed to door jamb 5*b*, by means of screws 26. Chain links 4 are interlocked to form a chain which is anchored at one end to bracket 3 by rivet 27 with its enlarged base 28, as shown in FIG. 5.

Bracket 3 generally includes a main body portion defining an upwardly facing slot 29, the function of which is to hold the chain in non-operative position when the opening of door 5*a* is unrestricted. Guard plate 2 is formed to include flanges 7 through which screws 6 project to hold guard plate 2 in place on door 5*a*. Guard plate 2 further includes a raised main body portion 8 which contains elongated slot 23, the end of which nearest to door jamb 5*b* is designated as the forward abutting end 25 of elongated slot 23. Raised portion 8 further contains a plurality of entry slots 30, 9*a* and 10*a*, 24 and 32 to permit attachment of chain links 4 to guard plate 2 in various ways. Correspondingly attached to chain links 4 are a plurality of chain heads, generally designated 11, 16, the insertion of which into elongated slot 23 is made possible by entry slots 24 and 30 respectively. As shown in FIG. 7, chain door guard plate 2' permits chain head 11 to be introduced through entry slot 9*a* into its seperate independent slot 10*a*, which is vertically oriented to latch the chain head 11 whether guard plate 2' is mounted on a right or left opening door 5*a*.

In addition, chain link 4*a* carries slide bolt 36 with its associated handle 38. Slide bolt 36 is formed to fit into space 34, defined by the surface of door 5*a* and the walls of raised portion 8 accommodates chain link 4*a* to permit insertion of slide bolt 36 into space 34.

Chain head 16 is provided with an outer head portion 17, a shank portion 19 of smaller diameter than that of head portion 17, an intermediate collar 18 generally the same size as head portion 17, and an inner head portion 20 of a size thickness matching entry slot 30. Similarly, chain head 11 comprises outer head portion 12, intermediate collar portion 13, shank portion 14, and inner head portion 15. Head portion 15, it is to be noted, is formed of a larger diameter and thicker than head portion 20 of chain head 16 so that chain head 11 may enter slot 24 and be moved into vertical slot 10, but it may not be inadvertently removed from elongated slot 23 through the smaller entry slot 30.

Operation

The component elements of my novel chain door guard 1 described above are illustrated in FIG. 1 in the open position with chain head 4*a* shown hanging free. In normal usage, however, when door 5*a* is open, chain head 11 is placed into slot 29 of bracket 30 and held there.

The optional operative modes of door guard assembly L are illustrated in FIGS. 2–4. According to the construction of the preferred embodiment, four selective operative positions may be utilized for chain door guard assembly L.

Firstly, chain head 11 may be inserted through entry slot 24 into elongated slot 23 so that operation is in accordance with that commonly used for presently available chain door guards. In other words, head 11 is introduced into elongated slot 23 while the door is closed. Inspection capability results from moving head 11 along elongated slot 23 to its forward abutting end 25 and the door 5*a* to the extent chain 4 allows. This degree of locking is shown in FIG. 2.

Secondly, head 11 can be positioned in elongated slot 23 through entry slot 24 and at the same time, head 16 can be inserted through entry slot 30 into elongated slot 23. An inspection capability is still provided in the same general manner as above, but the protection is literally twice as much, since the protective strength is now provided by both outer head portions 12 and 17, rather than just one chain head: and the opening of door 5*a* is further restricted by the reduced chain length operation between anchor 27 and chain head 16 when it reaches abutting end 25, This arrangement is shown in FIG. 3.

Thirdly, head 16 is placed in slot 23 through entry slot 30 while head 11 is inserted through entry slot 24 and slid into slot 10 so that inner head portion 15 rests in it accordingly. In this position, door 5*a* is interlocked tightly with its jamb 5*b* and yet the simple removal of head 11 from slot 10 restores the operational capability of the previously described positions.

Finally, the extra security of sliding bolt 36 introduced into space 34 through entry slot 32 may be employed either by itself, with the rest of chain 4 hanging free, or shown in FIG. 4, with head 16 in elongated slot 23 and head 11 in slot 10 for complete triple protection. It is to be noted that this chain door guard may be installed on a right or left opening door.

An alternate embodiment is shown in FIGS. 7 and 8, wherein reference characters designate like parts to those described above, but include primes for each corresponding part of the alternate embodiments. The primary difference here is the replacement of vertical slot 10 which depends on its chain entry into it through elongated slot entry 24 by providing a vertically truncated slot in its place in which the entry and removal of chain head 11 is independent of any other entry, said vertically truncated slot is fully illustrated, under 9*a* and 10*a* on FIG. 7, said entry and removal as is with the other truncated circular slots is by a tipping motion in either way.

Another embodiment is shown in FIGS. 9 and 10. A sliding bolt 36*a* which need not be limited to the shape and form of entry 34, is formed to enter entry 34, link 4*b* is attached in place of of 4*a* in the form of a would be roundish bolt if necessary.

I claim:

1. A chain door guard assembly for attachment to a mating door and door jamb comprising, in combination, a bracket for attachment to the door jamb, a chain rotatably attached to said bracket a guard plate for attachment to the door, said guard plate having a raised main body section containing a horizontally disposed elongated main slot, a first entry slot providing entry to said main slot near the end thereof adjacent to said jamb and a second entry to said main slot, and an open ended vertical slot extending above and below said main slot at the end of said main slot remote from said door jamb said main slot opens into said vertical slot, whereby a passageway is provided between said horizontal and vertical slots, a first chain head fixed to the end of said chain remote from said bracket, said first chain head adapted to be received by said second entry slot and being retained in either said main slot on said vertical slot, and a second chain head fixed to said chain between said first chain head and said bracket, said second chain head being adaptable to be used with or without said first chain head.

* * * * *

UNITED STATES PATENT OFFICE

CERTIFICATE OF CORRECTION

Patent No 4,082,333 Dated April 4, 1978

Inventor(s) Bernard C. Segal

It is certified that error appears in the above-identified patent and that said Letters Patent are hereby corrected as shown below:

On the cover sheet, Item (76) title should read:

-- Combination of Interlocking Security On Chain Door Guards --.

Column 4, line 22, "on" should read -- or --.

Signed and Sealed this

Seventeenth Day of October 1978

[SEAL]

Attest:

RUTH C. MASON
Attesting Officer

DONALD W. BANNER
Commissioner of Patents and Trademarks